United States Patent [19]

Wee et al.

[11] 4,259,199

[45] Mar. 31, 1981

[54] ALKALINE DISHWASHER DETERGENT

[75] Inventors: Maria Luz S. Wee, Cincinnati; Lawrence A. Gilbert; Jacob Mathew, both of Fairfield, all of Ohio

[73] Assignee: The Procter & Gamble Company, Cincinnati, Ohio

[21] Appl. No.: 76,696

[22] Filed: Sep. 18, 1979

Related U.S. Application Data

[63] Continuation-in-part of Ser. No. 53,163, Jun. 29, 1979, abandoned, which is a continuation-in-part of Ser. No. 958,587, Nov. 7, 1978, abandoned.

[51] Int. Cl.[3] ..... C11D 7/12; C11D 7/16; C11D 7/56

[52] U.S. Cl. ..... 252/99; 252/135; 252/174.14; 252/174.21

[58] Field of Search ..... 252/99, 135, 174.4, 252/174.14, 174.21

[56] References Cited

U.S. PATENT DOCUMENTS

| | | | |
|---|---|---|---|
| 3,166,512 | 1/1965 | Mizuno | 252/99 |
| 3,248,330 | 4/1966 | Feierstein | 252/99 |
| 3,356,612 | 12/1967 | Guthrie | 252/99 |
| 3,361,675 | 1/1968 | Fuchs | 252/99 |
| 3,399,144 | 8/1968 | Hathaway et al. | 252/99 |
| 3,600,317 | 8/1971 | Litner | 252/99 |
| 3,609,088 | 9/1971 | Sumner | 252/99 |
| 3,888,781 | 6/1975 | Kingry et al. | 252/99 |
| 3,936,386 | 2/1976 | Corliss et al. | 252/99 |
| 4,077,897 | 3/1978 | Gault | 252/99 |
| 4,105,573 | 8/1978 | Jacobsen | 252/99 |
| 4,187,190 | 2/1980 | McLaughlin et al. | 252/99 |
| 4,199,467 | 4/1980 | Barford et al. | 252/103 |
| 4,199,468 | 4/1980 | Novosel et al. | 252/103 |

FOREIGN PATENT DOCUMENTS

| | | | |
|---|---|---|---|
| 209882 | 8/1967 | Australia | 252/99 |

OTHER PUBLICATIONS

Madden et al., "Performance of No-Phosphate Dishwasher Detergents," Soap and Cosmetics and Chemical Specialties, Sep. 1974.

*Primary Examiner*—P. E. Willis, Jr.
*Attorney, Agent, or Firm*—Robert B. Aylor; Thomas H. O'Flaherty; Richard C. Witte

[57] ABSTRACT

Alkaline dishwasher detergent composition having a specific critical pH; relatively high levels of bleach, reserve alkalinity and surfactant; and, preferably, a specific mixture of alkali metal silicates. The detergent composition is substantially free of highly alkaline materials and organic builders.

19 Claims, No Drawings

ALKALINE DISHWASHER DETERGENT

This is a continuation-in-part of our copending U.S. Application, Ser. No. 053,163 filed June 29, 1979 which is a continuation-in-part of our copending U.S. application, Ser. No. 958,587, filed Nov. 7, 1978 for ALKALINE DISHWASHER DETERGENT both now abandoned.

TECHNICAL FIELD

This invention relates to detergent compositions which are particularly suitable for use in automatic dishwashers. Such compositions are normally alkaline, contain low levels of low foaming surfactants, and contain a source of available chlorine. In order to obtain good cleaning performance, the prior art compositions quite often contain a source of alkalinity which gives a pH greater than 12 at a 1% concentration or large amounts of phosphate builders or organic builders. However, it is known that sources of alkalinity such as alkali metal metasilicates and alkali metal hydroxides are relatively unsafe for inclusion in large amounts in a consumer product. Also, it is desirable to try to lower the amount of phosphorus contained in such compositions.

DISCLOSURE OF THE INVENTION

This invention is based upon the discovery that a series of modifications in conventional, automatic dishwasher compositions can give surprisingly optimal cleaning and spotting and filming results while increasing the safety of the compositions and lowering the amount of phosphorus required for a given level of performance. More specifically, this invention relates to automatic dishwasher compositions providing optimum cleaning and spotting and filming and consisting essentially of:

(1) sodium or potassium tripolyphosphate at a level of from about 10% to about 50% to provide no more than about 12% phosphorus, preferably less than about 10%, and most preferably about 9%;

(2) sodium or potassium carbonate to increase the reserve alkalinity of the product to from about 10 to about 20, preferably from about 12 to about 16, but no more than about 13% by weight of the carbonate;

(3) alkali metal silicate solids representing from about 6% to about 15%, preferably from about 8% to about 13% of $SiO_2$, but no more than about 20% by weight of silicate solids the silicate preferably being a mixture of alkali metal (sodium or potassium, preferably sodium) silicates of which (a) from 0 to about 10% by weight, preferably from about 2% to about 8%, based on the total formula, of silicate solids is present as hydrous silicate having an $SiO_2$:-$M_2O$ ratio of from about 2.0 to about 3.2, preferably 2.4, and a solids content of from about 75% to about 85% and (b) the remainder of the silicate is either 2.0r or mixture of (i) 2.0r and (ii) 3.0 to 3.6r, preferably 3.2r, silicates with from about 15% to about 100% of the total $SiO_2$, preferably from about 50% to 90%, of the $SiO_2$ in said mixture being provided by the 2.0r silicate and the remainder of the $SiO_2$ in said mixture being in the higher ratio silicates, and wherein M is selected from the group consisting of Na and K;

(4) available chlorine at a level of from about ¾% to about 2.5%, preferably from about 1% to about 2.1%, from a sodium or potassium dichlorocyanurate, preferably sodium dichlorocyanurate dihydrate; and (5) from about 2% to about 10%, preferably from about 3% to about 8%, of a low foaming nonionic surfactant which is the condensation product of a straight chain fatty alcohol containing from about 16 to about 20 carbon atoms, preferably from about 17 to about 19 carbon atoms with about 6 to about 15 moles of ethylene oxide per mole of alcohol, said composition having a pH of from about 9.8 to about 10.7, preferably from about 10.2 to about 10.5, at 2,500 ppm and being substantially free, i.e., less than about 5%, preferably less than about 2%, and most preferably entirely free of materials having a pH of 12 or more at a concentration of 1% in water and also being substantially free, i.e., less than about 10%, preferably less than 5% and most preferably completely free of organic chelating builders and orthophosphates.

The above compositions give optimal cleaning, superior spotting, and superior filming characteristics and improved processing and physical characteristics, using less phosphorus and less very highly alkaline materials than is required by the prior art to give equivalent levels of performance.

DETAILED DESCRIPTION OF THE INVENTION

The Detergency Builder

It is desirable that at least 10%, preferably at least 20%, of the composition is either sodium or potassium tripolyphosphate in order to provide good cleaning and spotting and filming (S/F) results. Since it is desirable to keep the phosphorus content of the composition as low as possible, it is preferred to use a level of from about 20% to about 50%, more preferably 30% to 40%, of these sequestering phosphate builders although increased levels up to 50% provide performance benefits. As the amount of sequestering phosphate builder is reduced below about 30%, the level of performance drops off drastically. In general, one would like to use as much of sequestering phosphate builder as possible given the limits that are permitted in formulation. The preferred sequestering phosphate builder is sodium tripolyphosphate.

In addition to serving as a sequestering builder, sequestering phosphate builders also are sources of alkalinity and buffering materials. They also are major sources of hydration capacity which assists in making the composition free-flowing initially and maintaining the free-flowing characteristics during storage.

The Reserve Alkalinity

The compositions of this invention contain sodium or potassium carbonate, preferably sodium carbonate, to increase the amount of reserve alkalinity without raising the pH above about 10.7 at 2500 ppm. Above a pH of about 10.7, the filming performance of these compositions becomes unacceptable as compared to the best current products. The pH of these products at 2500 ppm concentration will inherently be above a pH of 9.8 for good cleaning. Preferably, the pH is from about 10.2 to about 10.5.

The carbonates are unique in providing buffering in the proper range in the presence of the tripolyphosphate builder. Preferably, the reserve alkalinity at >4.5 pH will be at least 10 for good cleaning and below 20, preferably from about 12 to about 16 to avoid filming problems and damage to china etc. Reserve alkalinity is expressed as percent $Na_2O$ equivalent above 4.5 pH at 1% concentration.

The carbonate can also be added as sesquicarbonate. The level of carbonate should be below about 13% by weight and preferably about 10% to avoid problems with spotting and filming.

Dichlorocyanurate

Sodium or potassium dichlorocyanurate should provide available chlorine in an amount sufficient to provide available chlorine equal to about ¾% to about 2.5% by weight of the composition. A more preferred level is from about 1% to about 2.1% by weight of the composition. A high level of available chlorine helps the cleaning, especially on starchy soils, and improves spotting and filming.

The preferred source of available chlorine is sodium dichlorocyanurate dihydrate. Of these materials sodium dichlorocyanurate dihydrate is preferred for effectiveness, stability, availability, etc.

The Silicate

The compositions of this invention contain up to about 20%, preferably from about 6% to about 15%, preferably from about 8% to about 13%, of $SiO_2$ as a mixture of sodium or potassium silicates, preferably sodium silicates. These alkali metal silicate solids normally comprise from about 10% to about 20% of the composition. 1.0r to 3.6r silicates can be used although lower ratio silicates should be limited as taught elsewhere. 1.6r to 3.6r is preferred. A preferred silicate mixture is disclosed in the copending U.S. Patent application of Novosel et al, Ser. No. 902,577, filed May 4, 1978 and incorporated herein by reference. From about 0% to about 10%, most preferably from about 2% to about 8% by weight of the formula is silicate solids from a hydrous silicate having a ratio of $SiO_2$:$M_2O$ (M=Na or K) of from about 2 to about 3.2, preferably 2.4 and a solids content of from about 75% to about 85%. This hydrous silicate at the indicated levels provides $SiO_2$ and can provide a desirable balance between agglomerating characteristics and the ability to form free-flowing, non-caking agglomerates while avoiding formation of excessive insolubles in certain formulas. It also reduces the instability of the dichlorocyanurate by reducing the moisture level. Lower moisture levels in general are desirable, e.g., it helps to use high solids levels wet silicates. It is also desirable to use as much two ratio (2.0r) silicate as possible for the remainder of the silicate, which can also be a mixture of 2.0r and 3.0r to 3.6r silicates, for best overall performance as far as spotting and filming (S/F) is concerned on metal surfaces, as disclosed in the copending U.S. Patent Application of Barford et al, Ser. No. 902,578 filed May 4, 1978. The above applications are incorporated herein by reference. However, in order to improve materials protection, it is desirable to have at least about 10% of the total $SiO_2$ present in the mixture of 2.0r and 3.0r to 3.6r silicates as the higher ratio (3.0r to 3.6r) silicate, preferably a 3.2r silicate.

The Surfactant

It has been found, surprisingly, that at least about 2%, and not more than about 10%, preferably from about 3% to about 8%, of the specific low sudsing surfactant of this invention is required in order to provide optimum cleaning and S/F (spotting and filming characteristics) while maintaining satisfactory bleach stability. Care must be taken that the surfactant level is not too high for S/F reasons. A preferred level of surfactant is from about 3% to about 8%. The surfactant is an ethoxylated, nonionic surfactant and preferably the composition is essentially free of sulfonated or sulfated anionic surfactants.

The nonionic surfactant is:

(1) the condensation product of 1 mole of a saturated or unsaturated, straight chain, alcohol containing from about 16 to about 20 carbon atoms with from about 6 to about 15 moles of ethylene oxide. Specific examples of such compounds include: the condensation product of 1 mole of tallow fatty alcohol with about 9 moles of ethylene oxide; the condensation product of 1 mole of oleyl alcohol with 10 moles of ethylene oxide; the condensation product of 1 mole of $C_{19}$ alcohol and 8 moles of ethylene oxide; and the condensation product of one mole of $C_{18}$ alcohol and 8.25 moles of ethylene oxide.

The condensation product of a fatty alcohol containing from 17 to 19 carbon atoms, and being substantially free of chain lengths above and below these numbers, with from about 6 to about 15 moles, preferably 7 to 12 moles, most preferably 8 to 9 moles, of ethylene oxide provides superior S/F performance. More particularly, it is preferred that the fatty alcohol contain 18 carbon atoms and be condensed with from about 7.5 to about 12, preferably about 8 to 9, moles of ethylene oxide. It is even more preferred if the distribution of ethylene oxide condensation products is such as to give more than about 40%, preferably more than about 50% of the product within plus or minus two ethylene oxide moieties from the average. The preferred product contains less than about 2% unethoxylated alcohol and more than about 70% should contain less than about 10 ethoxy moieties. This distribution of ethylene oxide analogs can be obtained by using a high level of a very strong alkaline catalyst such as sodium metal or sodium hydride in e.g., a 1:1 molar ratio of catalyst to alcohol or by stripping a conventional ethoxylated alcohol. These various specific $C_{17}$–$C_{19}$ ethoxylates give extremely good performance even at lower levels (e.g., about 3%) and at the higher levels (about 9%) are sufficiently low sudsing, especially when capped with a low molecular weight ($C_{1-5}$) acid or alcohol moiety, so as to minimize or eliminate the need for a suds-suppressing agent. This is highly desirable since suds-suppressing agents in general tend to act as a load on the composition and to hurt long term S/F characteristics.

(2) The compounds of (1) which are capped with propylene oxide, butylene oxide and/or short chain alcohols and/or short chain fatty acids, e.g., those containing from 1 to about 5 carbon atoms.

(3) Mixtures thereof.

To minimize the tendency of formula containing these surfactants to cake, e.g., in dispensers, it is important that the surfactant be evenly distributed, especially for higher surfactant levels.

Other Ingredients

In addition to the above ingredients it may be desirable, if the product sudses too much, to incorporate one of the many suds-suppressing ingredients disclosed in U.S. Pat. Nos. 3,544,473; 3,630,923; 3,393,781; and 4,001,172, incorporated herein by reference, at a level of from about 0.001% to about 10%, preferably from about 0.05% to about 3%. The preferred suds suppressing materials are mono- and distearyl acid phosphates; the self-emulsified siloxane suds-suppressors of pending U.S. Pat. No. 4,075,118, by T. W. Gault and Edward John McGuire, Jr. and mixtures thereof. In general, lower amounts of, or no, suds-suppressors are preferred. Less than 0.2%, preferably less than 0.1% is desirable, more preferably none for best S/F, long term.

The compositions should contain less than about 5%, more preferably less than about 2%, and most preferably none of materials which have a pH greater than 12 at a concentration of 1% in water. Such materials are conventional components of automatic dishwashing compositions such as sodium metasilicate and sodium hydroxide. The content of such materials should be kept to the bare minimum for safety reasons.

Similarly, there should be no more than about 10%, preferably no more than about 5% and preferably no organic sequestering builders in the compositions. The presence of organic builders hurts the S/F performance of these compositions as disclosed in the copending U.S. Patent application of Gilbert et al, Ser. No. 849,132, filed Nov. 7, 1977, for Alkaline Dishwasher Detergent, said application being incorporated herein by reference. Exceptions are the builders disclosed in U.S. Pat. Nos. 4,144,226 and 4,146,495, issued Mar. 13, and Mar. 27, 1979 respectively, and incorporated herein by reference. They can replace the tripolyphosphate completely or at low levels to provide improved cleaning and insolubles suspension.

Other organic materials should preferably not be used in substantial amounts, i.e., the compositions should be free of antioxidants, random alkyl phosphonate soil-release agents, etc.

China protecting agents including aluminosilicates, aluminates, etc., may be present in amounts of from about 0.1% to about 5%, preferably from about 0.5% to about 2%.

Filler materials can also be present including sucrose, sucrose esters, sodium chloride, sodium sulfate, etc., in amounts from about 0.001% to about 60%, preferably from about 5% to about 30%.

Hydrotrope materials such as sodium benzene sulfonate, sodium toluene sulfonate, sodium cumene sulfonate, etc., can be present in minor amounts, but, as with other organic materials, their presence is normally minimized.

Dyes, perfumes, crystal modifiers and the like can also be added in minor amounts.

As used herein, all percentages, parts and ratios are by weight unless otherwise stated.

The following Examples illustrate the invention and facilitate its understanding.

EXAMPLES

| Example Component | I | II | III | IV | V | VI | VII |
|---|---|---|---|---|---|---|---|
| Sodium tripolyphosphate | 33.1 | 40.0 | 33.1 | 33.1 | 40.0 | 33.1 | 33.1 |
| 2.0r liquid sodium silicate (44% solids) | 10.0 | 10.0 | 15.0 | → | → | 17.0 | 17.4[1] |
| 3.2r liquid sodium silicate (39.3% solids) | 10.0 | 10.0 | 5 | → | → | 17.0 | 4.7[2] |

-continued

| Example Component | I | II | III | IV | V | VI | VII |
|---|---|---|---|---|---|---|---|
| 2.4r hydrous sodium silicate (81.5% solids) | 6.0 | → | → | → | → | 0 | 6 |
| Octadecanol condensed with 8.25 moles of ethylene oxide | 3 | 3.5 | 4 | 5 | 6 | 7.5 | 4 |
| $Na_2CO_3$ | 10.0 | → | → | → | → | 0 | 10 |
| Sodium dichlorocyanurate dihydrate | 2.5 | 2.5 | 3.75 | 2.5 | 2.5 | 2.5 | 2.5 |
| Sodium sesquicarbonate | 0 | → | → | → | → | Balance | 0 |
| $Na_2SO_4$ and minor ingredients | ← | ← | Balance | → | → | 0 | Balance |

[1]47.3% solids.
[2]37.5% solids.

What is claimed is:

1. An automatic dishwashing composition providing optimum cleaning, spotting and filming consisting essentially of:

(1) from about 20% to about 50% of alkali metal tripolyphosphate; (2) sodium or potassium carbonate in an amount to raise the reserve alkalinity of the composition to from about 10 to about 20, but no more than about 13% carbonate; (3) sodium or potassium silicate solids providing from about 6% to about 15% of $SiO_2$, but no more than about 20% silicate; (4) available chlorine at a level of from about ¾% to about 2.5% from a sodium or potassium dichlorocyanurate; and (5) from about 2% to about 10% of a low foaming nonionic surfactant which is the condensation product of a straight chain fatty alcohol containing from about 16 to about 20 carbon atoms and from about 6 to about 15 moles of ethylene oxide per mole of alcohol said composition having a pH of from about 9.8 to 10.7 at 2,500 ppm and being substantially free of (a) materials having a pH of 12 or more at a concentration of 1% in water, (b) orthophosphates and (c) organic chelating builders.

2. The composition of claim 1 which is completely free of materials having a pH of 12 or more at a concentration of 1% in water.

3. The composition of claim 1 which is completely free of organic chelating builders.

4. The composition of claim 3 which is completely free of materials having a pH of 12 or more at a concentration of 1% in water.

5. The composition of claim 4 containing available chlorine at a level of from about 1% to about 2.1%.

6. The composition of claim 5 containing from about 3% to about 8% of the low foaming nonionic surfactant.

7. The composition of claim 5 containing from about 8% to about 13% of $SiO_2$ as sodium silicate.

8. The composition of claim 5 containing from about 30% to about 40% of sodium tripolyphosphate.

9. The composition of claim 5 wherein the available chlorine is provided by sodium dichlorocyanurate dihydrate.

10. The composition of claim 9 wherein the nonionic surfactant is present at a level of from about 3% to about 8%.

11. The composition of claim 1 wherein the silicate is a mixture of alkali metal silicates of which (a) from about 1% to about 10%, of the total formula is present as hydrous silicate having an $SiO_2:M_2O$ ratio of from about 2.0r to about 3.2r and a solids content of from about 75% to about 85%, and (b) the remainder of the silicate is a mixture of 2.0r and 3.0r to 3.6r silicates with from about 15% to about 90% of the $SiO_2$ in said mixture being provided by the 2.0r silicate, and the remainder of the $SiO_2$ in said mixture being provided by the higher ratio silicate, and wherein M is selected from the group consisting of sodium and potassium.

12. The composition of claim 11 which is completely free of materials having a pH of 12 or more at a concentration of 1% in water.

13. The composition of claim 11 which is completely free of organic chelating builders.

14. The composition of claim 13 which is completely free of materials having a pH of 12 or more at a concentration of 1% in water.

15. The composition of claim 14 containing available chlorine at a level of from about 1% to about 2.1%.

16. The composition of claim 15 containing from about 3% to about 8% of a low foaming nonionic surfactant.

17. The composition of claim 15 containing from about 10% to about 13% of $SiO_2$ as sodium silicate.

18. The composition of claim 15 containing from about 30% to about 40% of sodium tripolyphosphate.

19. The composition of claim 15 wherein the available chlorine is provided by sodium dichlorocyanurate dihydrate.

* * * * *